US005324029A

United States Patent [19]

Kim

[11] Patent Number: 5,324,029

[45] Date of Patent: Jun. 28, 1994

[54] PRACTICE SPORTS RACKET

[76] Inventor: Edward Kim, 11436 Stapleton Ct., Cerritos, Calif. 90701

[21] Appl. No.: 82,540

[22] Filed: Jun. 28, 1993

[51] Int. Cl.[5] ..... H63B 69/38

[52] U.S. Cl. ..... 273/67 R; 273/73 R; 273/346; 273/DIG. 30

[58] Field of Search ..... 273/29 R, 29 A, 67 R, 273/73 R, 73 C, 327, 346, 412, DIG. 30

[56] References Cited

U.S. PATENT DOCUMENTS

| | | | |
|---|---|---|---|
| 4,029,316 | 6/1977 | Clarke | 273/346 X |
| 4,131,278 | 12/1978 | Goldenberg | 273/67 R |
| 4,148,483 | 4/1979 | Sweet et al. | 273/67 R |
| 5,080,374 | 1/1992 | Yu | 273/327 X |
| 5,160,147 | 11/1992 | Ping | 273/DIG. 30 |
| 5,203,572 | 4/1993 | Lirn | 273/346 X |
| 5,240,257 | 8/1993 | Sassak | 273/346 X |

FOREIGN PATENT DOCUMENTS

| | | | |
|---|---|---|---|
| 2502652 | 7/1975 | Fed. Rep. of Germany | 273/346 |
| 3321343 | 12/1984 | Fed. Rep. of Germany | 273/DIG. 30 |

*Primary Examiner*—William Stoll
*Attorney, Agent, or Firm*—Howard A. Kenyon

[57] ABSTRACT

A practice sports racket and ball in combination is disclosed. The racket has an elastic member stretched over both sides of the frame. The elastic member is partly covered with the hook fasteners of hook and loop fastener material and the ball is covered with the loop fasteners of hook and loop fastener material. The center of this practice sports racket, sometimes referred to as the "sweet spot" is void of any hook fastener material. In practice, if the ball hits the "sweet spot", it will rebound as a normal hit. However, if the ball is off center, it will be contained as the loop fastener material on the ball makes contact with the hook fastener material on the practice sports racket.

15 Claims, 3 Drawing Sheets

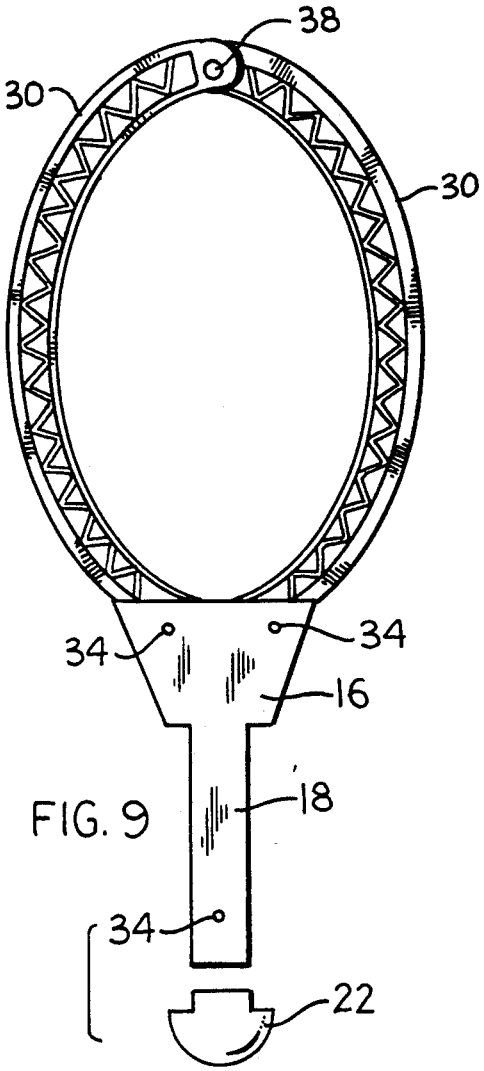
FIG. 9
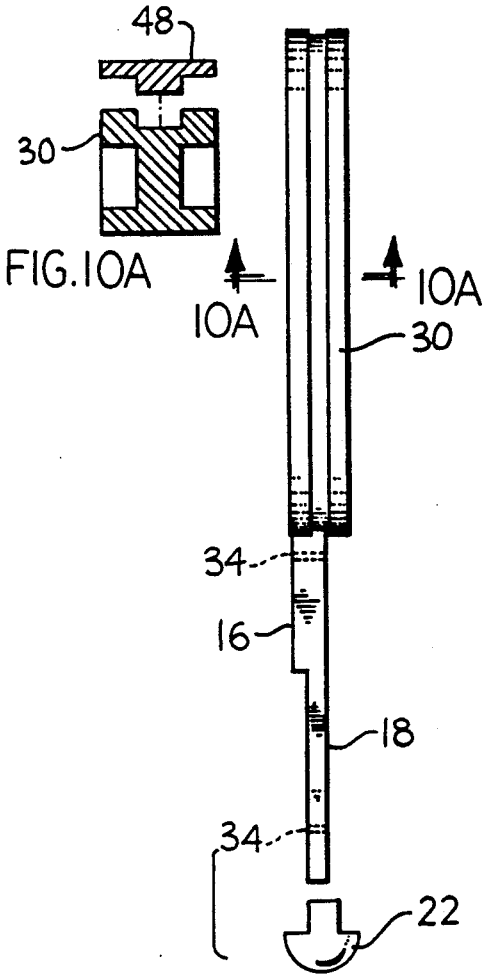
FIG. 10A
FIG. 10
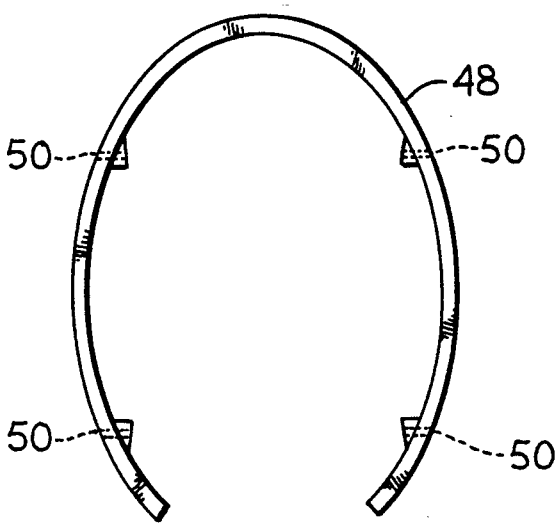
FIG. 11
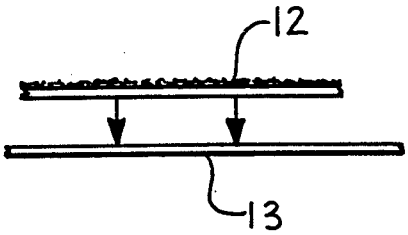
FIG. 12

PRACTICE SPORTS RACKET

BACKGROUND OF THE INVENTION

1. Field of the Invention

This invention relates to a practice sports racket that is used to improve ones ability to hit the ball in the center of the racket. More specifically if the ball is hit in the center, it will rebound as a normal hit. If the ball is not hit in the center, hook fastener material on the surface of the racket and loop fastener material on the surface of the ball will contain the ball on the face of the racket.

2. Description of the Prior Art

There are many devices in various sports such as tennis, racquet ball, squash and badminton that are designed to improve ones ability to obtain the maximum efficiency when striking the ball. One such device is a modified tennis racket in U.S. Pat. No. 4,471,958 to Piche such that one will feel a different vibration when the "sweet spot" makes contact with the ball. U.S. Pat. No. 4,079,935 to Gormley is very similar to Pecker except there is an aural indicator. U.S. Pat. No. 5,031,909 to Pecker describes an regular tennis racket that has some of the strings attached to force sensors in electronic circuitry. When the "sweet sport" is hit an audible sound will be emitted.

U.S. Pat. No. 4,143,873 to Andreoli has the "sweet spot" eliminated and allows the ball to pass through the racket.

U.S. Pat. No. 3,820,785 to Occhipinti et al utilizes a mask placed over the strings of a conventional tennis racket. Occhipinti fastens the mask in one embodiment with laced strings and in another embodiment with VELCRO.

U.S. Pat. No. 5,160,147 to Ping is a toy ball game set which utilizes fastening fabric on the ball and on one side of the racket. However, the opposite side of the racket is free of fastening material since the opposite side is used to rebound the ball. There is no training whatsoever since the "sweet spot" is also covered with fastening material and the ball will always be caught by the racket.

None of the above training devices utilize the hook fastener material bonded on the surface of the racket and the loop fastener material bonded on the surface of the ball.

What is needed is a training racket that allows the ball to rebound when the "sweet spot" area is utilized in rebounding and a penalty is incurred when the ball is hit off center by having the ball caught by the material on the racket. The present invention also utilizes the same configuration on both sides of the racket to train for back hand strokes as well as foreward strokes.

SUMMARY OF THE INVENTION

It is the object of the present invention to provide a practice sports racket to be utilized in training by hitting the ball in the center of the racket. It is another object of the present invention to utilize an elastic member on both sides of the racket that will rebound a ball if hit in the center of the racket.

It is yet another object of the present invention to penalize a user if the ball is hit off center and the ball is caught by fastening material.

It is still another object of the present invention to utilize high impact plastic for the practice racket that will provide long life even when the racket is struck on the court.

Briefly, in accordance with the invention, there is provided practice sports racket used in training to hit a ball in the center of the racket. The racket frame is made of high impact plastic and an elastic member fits over the frame. The frame is made in two pieces that pivot at a point opposite the handle. The frame is slipped into the elastic member and when the handle is pulled apart, the elastic member is stretched tight. The frame is fastened by fastening means through a triangular web located between the frame and the handle and with fastening means through the handle. The handle is covered by a sponge rubber grip surface and a cap member, having a wrist strap located on the end of the handle. A rim guard is fastened around the rim of the frame to protect the elastic member from abrasion. Located on part of the elastic member is hook fastener material that will catch a ball containing loop fastener material. The center area of the racket called the "sweet sport" is void of any hook fastener material and the ball will rebound when hit in the center area. A user, training, will attempt to hit the ball in the "sweet sport" to prevent from being penalized and have the call containing loop fastener material caught by the racket containing hook fastener material.

The novel features which are believed to be characteristics of the invention as to the system together with further objects and advantages thereof, will be better understood from the following description in connection with the accompanying drawings in which the present preferred embodiments of the invention are illustrated by way of example. It is to be expressly understood, however, that the drawings are for purposes of illustration and description only, and are not intended as a definition of the limits of the invention.

DESCRIPTION OF THE DRAWINGS

In the drawings which illustrate the best mode presently contemplated for carrying out the present invention:

FIG. 9 is a plan view showing the two sides of the frame in their final position. The end cap is also shown in this view.

FIG. 10 is a side view showing one-half of a frame. The end cap is also shown in this view.

FIG. 10A is a cross section of the rim guard grooves.

FIG. 11 is a plan view of the rim guard.

FIG. 12 is an isolated cross section showing the hook fastener material being bonded to the elastic member.

These and other objects, features and advantages of the present invention will become more readily apparent upon detailed consideration of the following description of a preferred embodiment with reference to the accompanying drawings.

DESCRIPTION OF THE PREFERRED EMBODIMENT

Figure 1:
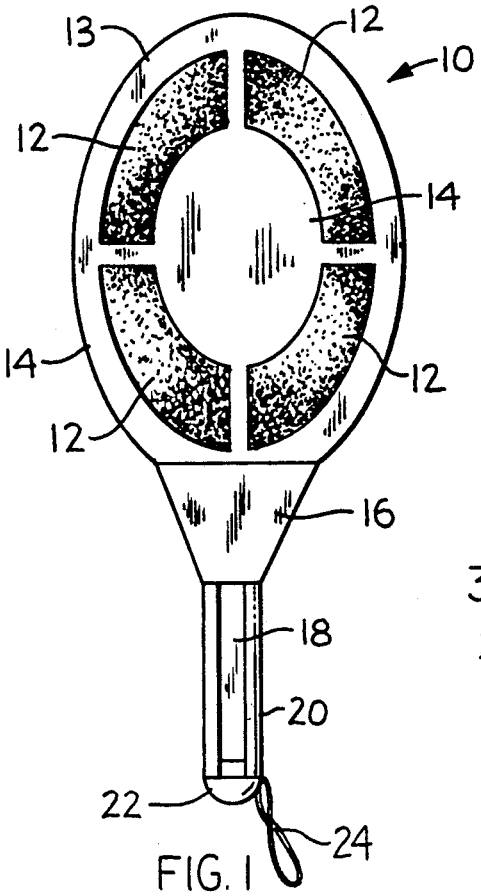
FIG. 1 is a plan view of the completely assembled practice sports racket.

Turning now to FIG. 1, there is shown the completely assembled practice sports racket, having a racket head and a handle, generally shown as 10. In this view hook fastener material 12 is in four places on the elastic member 13 on the face of the racket 10. The elastic member 13, without any hook fastener material 12 fastened thereto is shown as 14. Also seen in this view is triangular web member 16, handle 18, sponge rubber handle cover 20, end cap 22 and wrist strap 24. It should be noted that only one side of the sports racket 10 is shown. The other side is a mirror image of the side shown in FIG. 1. Sponge rubber handle 20 is contoured to fit a hand and is bonded over handle 18.

Figure 2:
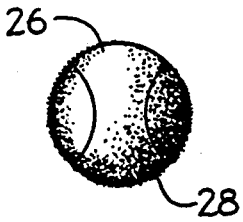
FIG. 2 is a view showing a modified tennis ball to be used with the practice sports racket.

Turning now to FIG. 2, there is seen an ordinary tennis ball 26 which has been modified by having loop fastener material 28 bonded over the entire ball 26.

Figure 3:
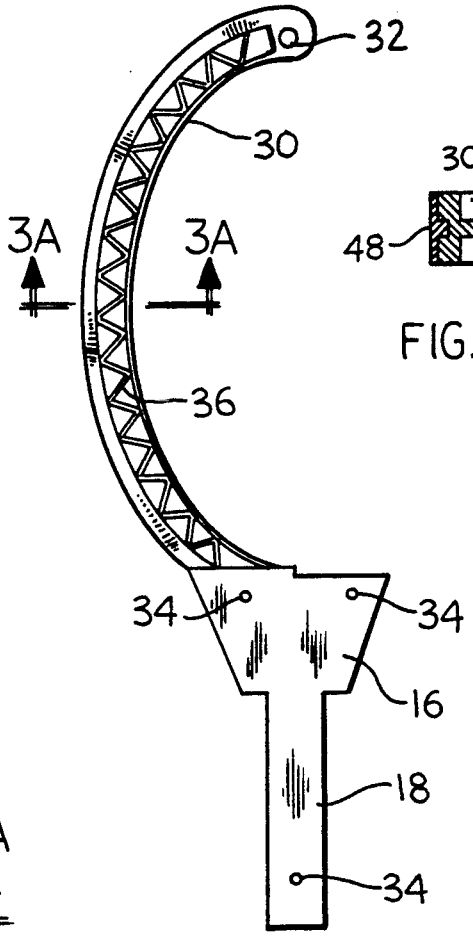
FIG. 3 is a plan view showing the details of the structure of one half the frame.
Figure 5:
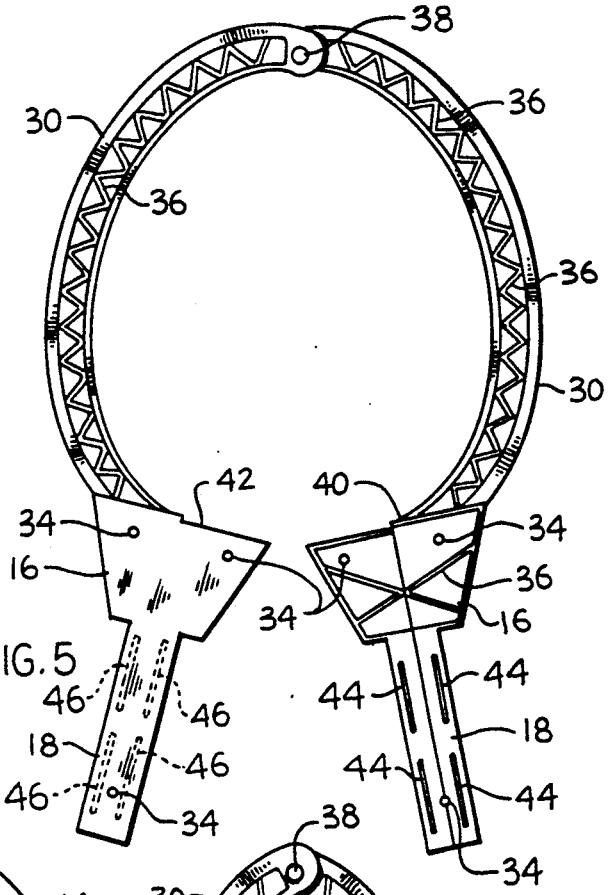
FIG. 5 is a plan view of the frame fastened at the top and rotated to an open position.
Figure 7:
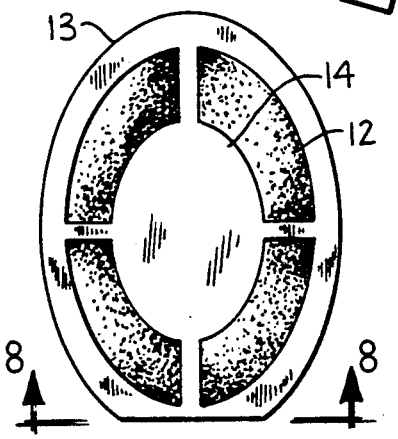
FIG. 7 is a plan view showing how the bottom of the elastic member provides an opening.
Figure 6:
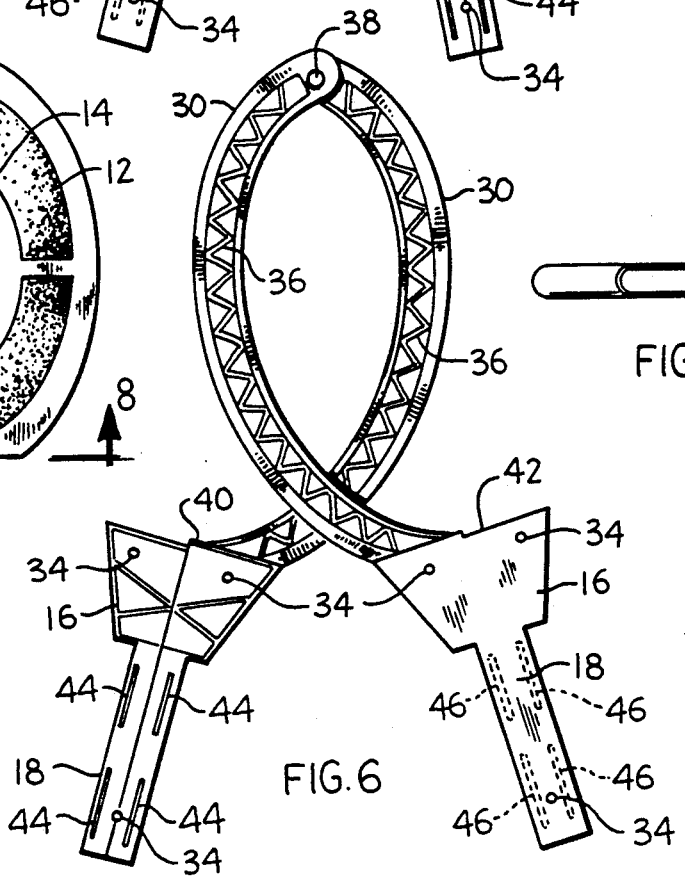
FIG. 6 is a plan view of the frame rotated to a closed position to fit inside the elastic member.

FIG. 3 is one-half of the frame 30, triangle web member 16 and handle 18. Also shown in this view is the drilled hole 32 that fasten the two halves of the frame at the top. The other half of the frame as shown in FIGS. 5 and 6, is exactly opposite the one shown in FIG. 3. Also seen in this view are the drilled holes 34 that will be used to fasten the two halves in the triangular web member 16 and the handle 18.

Figure 3A:
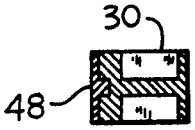
FIG. 3A is a cross section view of the frame.

FIG. 3A shows the cross section of the structure of the frame 30. The webs 36 are integrated into the structure to provide lightness in addition to strength.

Figure 4:
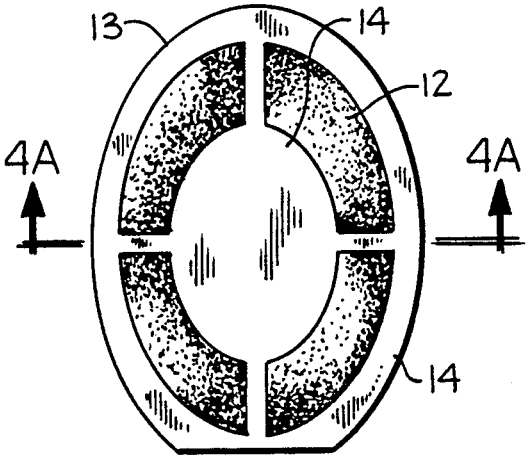
FIG. 4 is a plan view of the elastic member that fits over both halves of the frame.

FIG. 4 shows the elastic member which is shown as 13 which has on the surface hook fastener material 12 and areas void of hook fastener material 14.

Figure 4A:
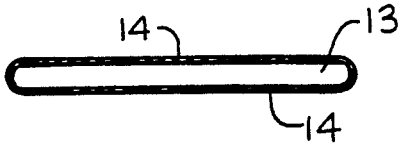
FIG. 4A is a cross section of the elastic member taken at the center.

FIG. 4A shows a cross section in the center of the elastic member 13.

FIG. 5 shows the two halves of the frames 30 fastened at the top. The fastening device 38 is designed to allow the frames 30 to rotate. Also seen in this view are webs 36 which provide strength and lightness to the frame 30.

FIG. 6 shows the frames 30 rotated to a closed position. The frames 30 are rotated until they will fit inside the elastic member 13. Also seen in this view is a web 40 that fits in notch 42 when the two halves of the frames are mated. In addition, webs 44 fit in slots 46 to hold the handle together.

Figure 8:
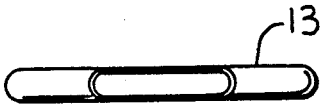
FIG. 8 is a cross section of the bottom opening in the elastic member.

FIG. 8 provides an opening when the frames in the closed position shown in FIG. 6 can be inserted. Once the frames shown in FIG. 6 are inserted in the opening shown in FIG. 8, the frames are then moved toward an open position when the triangular web member 16 and the handle 18 of each half of frame 30 mate. This simultaneously stretches the elastic member 13 to fit firmly over the frames 30. The frames 30 are fastened together by fastening means through drilled holes 34. Fastening means may be screwed, rivets or bolts (not shown) or the like.

FIG. 9 shows a complete practice sports racket minus the elastic member containing the VELCRO hook fastener material.

FIG. 10 is a side view of one-half of a frame 30. FIG. 10A is a cross section view of rim guard 48 and frame 30. It is seen that rim guard 48 fits into frame 30. Fastening means (not shown) such as screws, rivets or bolts or the like hold the rim guard 48 onto the frame 30. The cap 22 is also shown in this view. Cap 22 fits into the end of handle 18 and is held in the handle by flexible plastic snaps (not shown).

FIG. 11 shows the rim guard 48 which was previously discussed fitting on frame 30. Fastening means will be placed through holes 50. The rim guard is made from high impact plastic and will protect the elastic member 13 from damage if the racket hits the court surface.

FIG. 12 shows an isolated view of the VELCRO hook fastener material 12 to be bonded on the surface of the elastic member 13. The bonding agent is unique and is made from a mixture of pulverized nylon and cotton powder applied to the surface of the elastic member 13 when the hook fastener material 12 is to be bonded. The book fastener material 12 being cut to the desired shape has double sided tape (not shown) applied to the surface to be bonded. This combination of hook fastener material and bonding agent is held together while a low frequency heat is being applied until the hook fastener material is bonded to the elastic member 13. The elastic member is made from a combination of 35% to 65% nylon and 35% to 45% SPANDEX. The material for the elastic member 13 is cut to size and sewn at the edges to form a shape like a glove.

Thus, it is apparent that there has been provided in accordance with the invention, a practice sports racket that fully satisfied the objectives, aims and advantages set forth above. While the invention has been described in conjunction with specific embodiments therefor, it is evident many alternatives, modifications and variations will be apparent to those skilled in the art in lieu of the foregoing description. Accordingly, it is intended to embrace all such alternatives, modifications, and variations that fall within the spirit and scope of the appended claims.

What is claimed is:

1. A practice sports racket and ball in combination comprising:

a handle;

a racket head connected to said handle, said racket head being a frame of planar elliptical shape, said frame also having a major axis and a minor axis;

a truncated triangular web located between said frame and said handle;

an elastic member containing hook fastener material fitted on both sides of said frame, said elastic member being in tension covering said frame;

a cap member located on the end of said handle, said cap member having a wrist strap fastened thereto;

a rim guard surrounding said frame and further fitted over said elastic member covering said frame;

a ball having loop fastener material attached thereto.

2. A practice sports racket as described in claim 1 wherein said elastic member covering said elliptical frame has said hook fastener material attached thereto in an elliptical pattern around said frame. said elliptical pattern having a circular center void of said hook fastener material in the center of said elliptical member, said elliptical pattern also having rectangular voids of said hook fastener material along said major and said minor axis of said frame;

3. A practice sports racket as described in claim 2 wherein said hook fastener material is bonded to said elastic member whereby contacting said ball with said sports racket elastic member allows said ball to rebound from said portion of said elastic member void of any hook fastener material but will be contained by said elastic member when said ball connects with said elastic member containing said hook fastener material.

4. A practice sports racket as described in claim 1 wherein said frame member is made from high impact polystyrene and is formed in two sections, each section of said frame having one half of said handle and one half of said truncated triangular web member.

5. A practice sports racket as described in claim 4 wherein each of said frames is joined by a fastening means at the intersection of said major axis of said frame opposite said handle.

6. A practice sports racket as described in claim 4 wherein one half of said truncated triangular web member and one half of said handle mate in a overlapping position to form said truncated triangular web member and said handle.

7. A practice sports racket as described in claim 4 wherein said handle and said truncated triangular member has fastening means inserted there through.

8. A practice sports racket as described in claim 1 wherein said cap is fastened to the end of said handle by flexible plastic snaps.

9. A practice sports racket as described in claim 1 wherein said handle contains a contoured sponge rubber handle cover bonded to said handle.

10. A practice sports racket as described in claim 1 where said truncated triangular web member and said handle have fastening means holding said mating truncated triangular web member and said mating handle in a juxtaposed relationship.

11. A practice sports racket as described in claim 1 wherein said elastic member material comprises 55% to 65% nylon and 35% to 45% SPANDEX.

12. A method of making a practice sports racket and ball in combination comprising:

providing a handle having a truncated triangular web member with a racket head attached thereto, said racket head being a planar elliptical frame having a major axis and a minor axis, said frame formed in two sections, each frame having one half of a handle and one half of a truncated triangular web member, said truncated triangular web member located between said frame and said handle, said frame rotatably attached at one end of said major axis opposite said handle;

providing an elastic member over said racket head;

providing hook fastener material;

bonding said hook fastener material to said elastic member on both sides of said elastic member, said elastic member having a circular void of said hook fastener material in the center of said elastic member and rectangular voids of said hook material along said major and said minor axis of said frame;

inserting a fastener at the intersection of said major axis of said frame opposite said handle;

rotating said frames in an open direction until said elastic member is in tension and said one half truncated triangular web members and said one half handle members mate in a juxtaposed position;

fastening said truncated triangular web member and said handle with fastening means;

providing a sponge rubber handle cover and an end cap containing a wrist strip attached to said end cap;

fitting and bonding said sponge rubber handle cover over said handle;

attaching said end cap containing said wrist strap by flexible plastic snaps to the end of said handle;

providing a rim guard;

fastening said rim guard around the pheripheral of said frame on the outside of said elastic member;

providing a ball having hoop fastener material attached thereto whereby said ball may be rebound when contacting with the portion of said elastic member being void of any hook material but will be contained by said racket when said ball connects with a portion of said elastic member containing said hook material.

13. A method of making a plastic sports racket as described in claim 12 wherein said frame, said handle, triangular web member and rim guard are made from a high impact polystyrene.

14. A method of making a plastic sports racket as described in claim 12 wherein said elastic member comprises 55% to 65% nylon and 34% to 45% SPANDEX.

15. A method of making a practice sports racket as described in claim 12 and further the method of applying said hook material to said elastic member comprising:

applying a double sided tape to the back of said hook fastener material;

applying a mixture of pulverized nylon and cotton powder to the surface area of said elastic member wherein said hook fastener material is to be attached;

bonding said hook material to said elastic member by applying low frequency heat.

* * * * *